US008256569B1

(12) United States Patent
Huff et al.

(10) Patent No.: US 8,256,569 B1
(45) Date of Patent: Sep. 4, 2012

(54) EXHAUST SOUND ATTENUATION DEVICE AND METHOD OF USE

(76) Inventors: Dennis L. Huff, North Olmsted, OH (US); Ronald G. Huff, Westlake, OH (US)

( * ) Notice: Subject to any disclaimer, the term of this patent is extended or adjusted under 35 U.S.C. 154(b) by 0 days.

(21) Appl. No.: 13/228,756

(22) Filed: Sep. 9, 2011

Related U.S. Application Data

(60) Provisional application No. 61/389,366, filed on Oct. 4, 2010.

(51) Int. Cl.
*F01N 1/10* (2006.01)
*F01N 1/24* (2006.01)
*F01N 1/00* (2006.01)

(52) U.S. Cl. ..... 181/252; 181/256

(58) Field of Classification Search ..... 181/252, 181/256, 249, 227, 228, 255, 250
See application file for complete search history.

(56) References Cited

U.S. PATENT DOCUMENTS

| | | | | | |
|---|---|---|---|---|---|
| 1,811,762 | A | * | 6/1931 | Schnell | 181/248 |
| 1,844,105 | A | * | 2/1932 | Schnell | 181/252 |
| 1,844,106 | A | * | 2/1932 | Schnell | 181/252 |
| 1,927,213 | A | * | 9/1933 | Mackenzie et al. | 181/258 |
| 1,972,065 | A | * | 8/1934 | Noblitt | 181/249 |
| 2,016,253 | A | * | 10/1935 | Noblitt et al. | 181/249 |
| 2,043,731 | A | * | 6/1936 | Bourne | 181/248 |
| 2,046,193 | A | * | 6/1936 | Spicer | 181/252 |
| 2,075,088 | A | | 3/1937 | Blanchard | |
| 2,185,584 | A | * | 1/1940 | Boyce | 55/517 |
| 2,326,612 | A | * | 8/1943 | Bourne | 181/252 |
| 2,512,155 | A | | 6/1950 | Hill | |
| 2,567,568 | A | * | 9/1951 | Lievense et al. | 181/272 |
| 2,583,366 | A | * | 1/1952 | Engels | 181/252 |
| 2,904,125 | A | * | 9/1959 | Roland et al. | 181/248 |
| 2,943,695 | A | * | 7/1960 | Jeffords | 181/243 |
| 2,988,302 | A | * | 6/1961 | Smith | 244/15 |
| 3,166,382 | A | * | 1/1965 | Purse et al. | 422/176 |
| 3,180,712 | A | * | 4/1965 | Hamblin | 422/171 |
| 3,955,643 | A | | 5/1976 | Clark | |
| 4,091,892 | A | * | 5/1978 | Hehmann et al. | 181/286 |
| 4,109,754 | A | * | 8/1978 | Purhonen | 181/252 |
| 4,116,303 | A | * | 9/1978 | Trudell | 181/252 |
| 4,226,298 | A | | 10/1980 | Bancel et al. | |
| 4,314,621 | A | * | 2/1982 | Hansen | 181/233 |
| 4,523,662 | A | * | 6/1985 | Tanaka et al. | 181/249 |
| 4,580,656 | A | | 4/1986 | Fukuda | |
| 4,589,517 | A | | 5/1986 | Fukuda | |
| 4,595,073 | A | * | 6/1986 | Thawani | 181/265 |
| 5,246,473 | A | | 9/1993 | Harris | |
| 5,350,888 | A | | 9/1994 | Sager, Jr. et al. | |
| 5,371,331 | A | | 12/1994 | Wall | |
| 5,661,272 | A | * | 8/1997 | Iannetti | 181/256 |
| 5,783,780 | A | | 7/1998 | Watanabe et al. | |
| 5,810,566 | A | * | 9/1998 | Pauwels | 417/312 |

(Continued)

*Primary Examiner* — Edgardo San Martin
(74) *Attorney, Agent, or Firm* — James A. Lucas; Driggs, Hogg, Daugherty & Del Zoppo Co., LPA

(57) ABSTRACT

A sound muffler combines a resonator chamber with a dissipative layer surrounding a through pipe. The muffler provides sound attenuation over a wide range of sound frequencies while maintaining unimpeded flow of gases through the pipe. This attenuation is achieved by combining dissipation with a frusto-conical resonant chamber. The dissipation is achieved by encircling the through passage with a layer of low density material such as metallic or ceramic foam or loosely packed fibers of a heat resistant material. The low density material attenuates the high frequency waves while permitting the passage of low frequency sound waves into the frusto-conical resonant chamber.

7 Claims, 8 Drawing Sheets

U.S. PATENT DOCUMENTS

| | | | | |
|---|---|---|---|---|
| 5,892,186 | A | 4/1999 | Flugger | |
| 5,902,970 | A | 5/1999 | Ferri | |
| 6,158,546 | A | 12/2000 | Hanson et al. | |
| 7,104,358 | B2 | 9/2006 | Frederiksen | |
| 7,267,297 | B2 * | 9/2007 | Campbell et al. | 244/1 N |
| 7,281,605 | B2 * | 10/2007 | Huff et al. | 181/250 |
| 7,364,011 | B2 * | 4/2008 | Hirschorn et al. | 181/248 |
| 7,367,424 | B2 * | 5/2008 | Brown et al. | 181/250 |
| 7,380,397 | B2 | 6/2008 | Chang | |
| 7,424,931 | B2 * | 9/2008 | Smith | 181/256 |
| 2002/0134614 | A1 * | 9/2002 | Chen | 181/252 |
| 2005/0223703 | A1 | 10/2005 | Wagner et al. | |

* cited by examiner

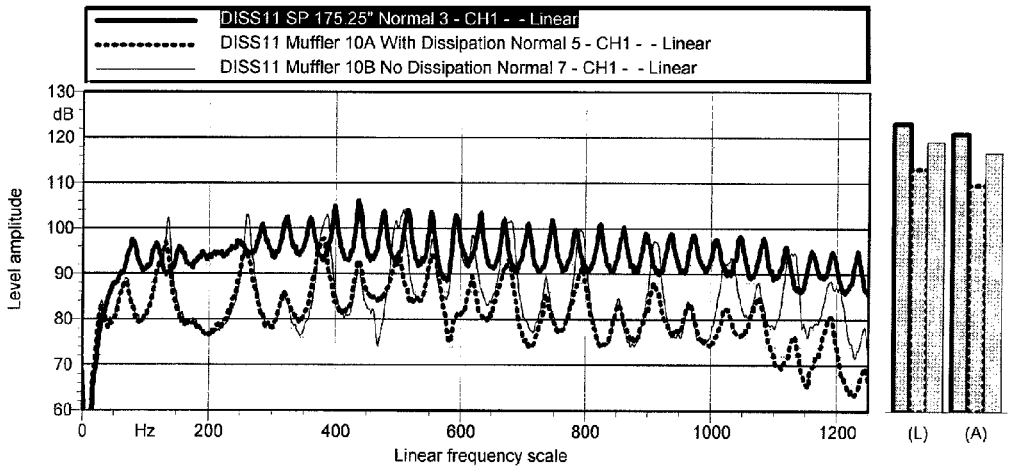
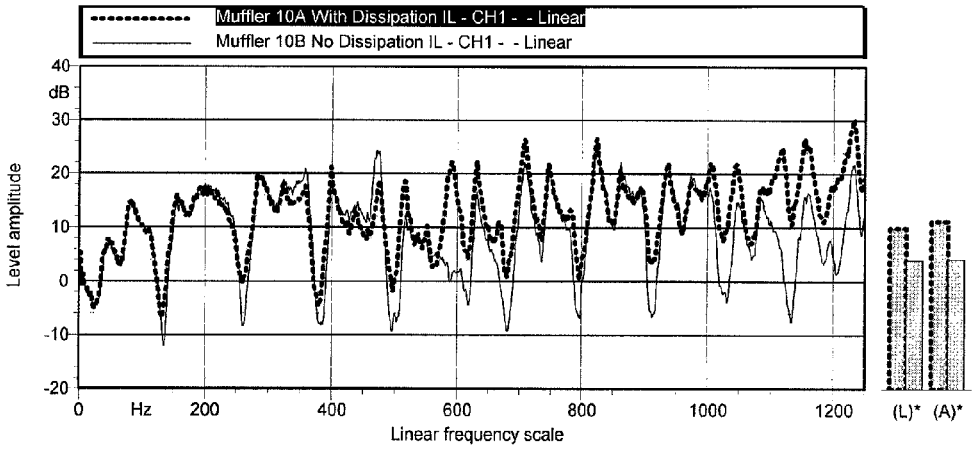
Figure 5 SPL and Insertion Loss Comparisons, 0 to 1250 Hz.

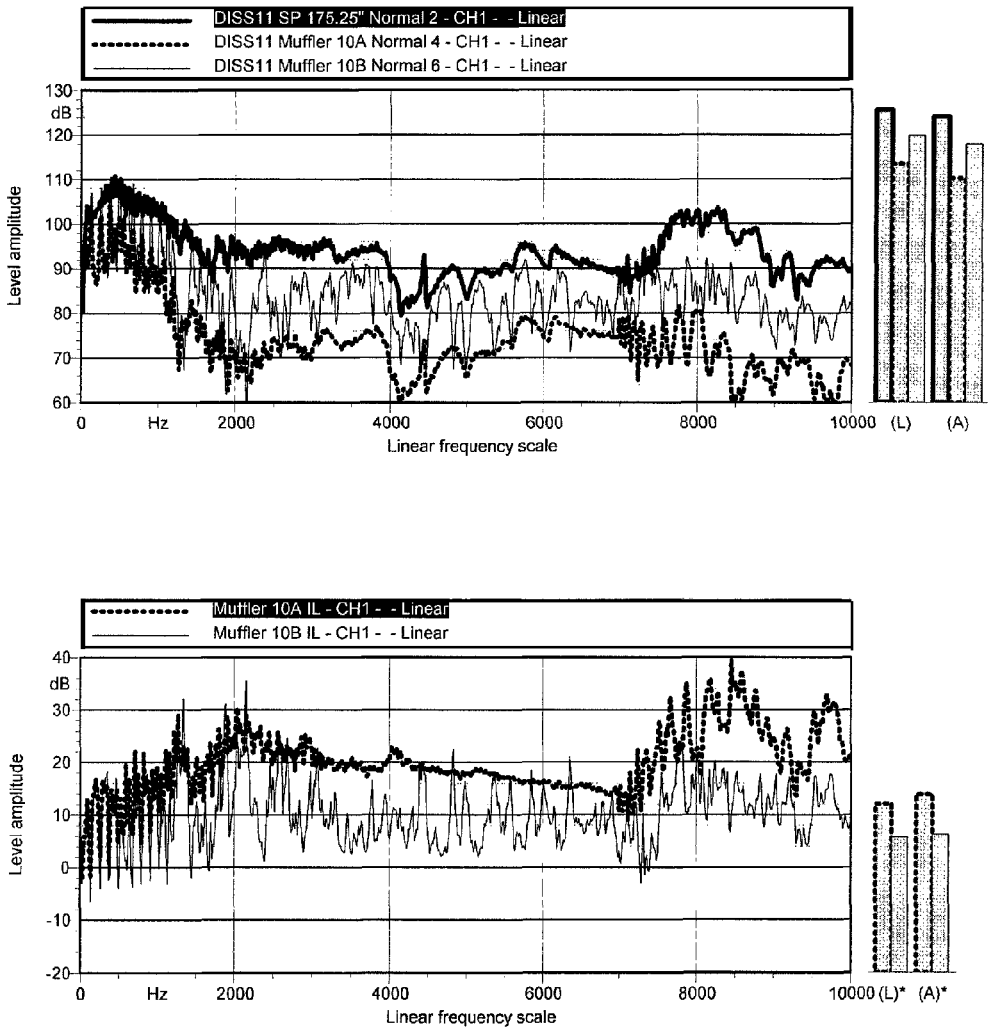
Figure 6 SPL and Insertion Loss Comparisons, 0 to 10 kHz.

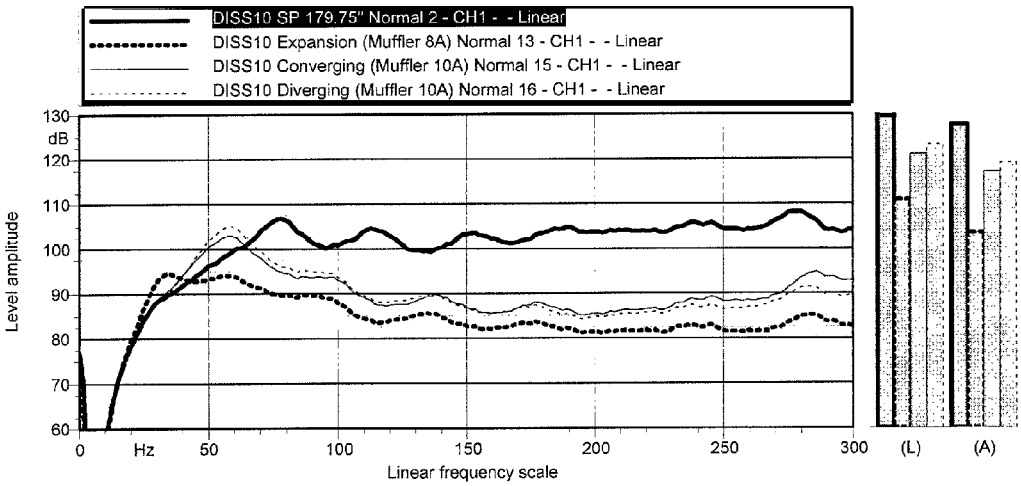
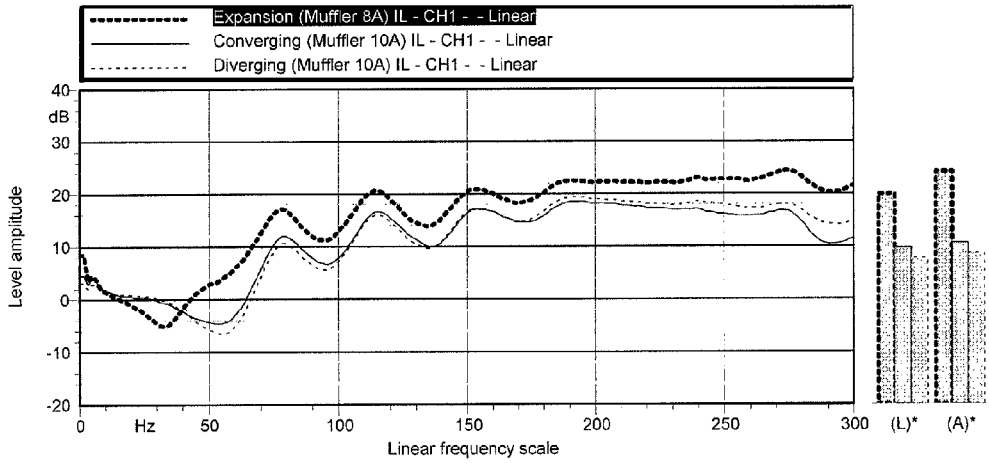
Figure 7 SPL and Insertion Loss Comparisons, 0 to 1250 Hz.

EXHAUST SOUND ATTENUATION DEVICE AND METHOD OF USE

RELATED APPLICATION

This application claims the benefits of the following provisional patent application previously filed in the United States Patent and Trademark Office by common inventors Dennis L. Huff and Ronald G. Huff entitled "EXHAUST SOUND ATTENUATION DEVICE AND METHOD OF USE," filed Oct. 4, 2010, Ser. No. 61/389,366, Confirmation No. 1136.

BACKGROUND OF THE INVENTION

Devices such as fans, internal combustion engines and compressors generate pressure pulses and flow pulses in their exhausts. In particular, with devices such as the internal combustion engines, products of combustion comprise the flow pulses. The pressure and flow pulses are sources of noise, and any restrictions in the flow can create a back pressure that adversely affects the operational efficiency of the device. The equipment that is used to mitigate or reduce the noise level of the pressure and flow pulses in the exhaust gas is commonly referred to as a muffler.

There are many different designs and functional shapes of mufflers. In many cases, the designs of these mufflers create substantial back pressure or do not adequately reduce the sounds that are emitted from an exit such as a tail pipe.

Exhaust noise can be characterized at the outlet by acoustic spectra with combinations of tones and broadband sound pressure levels. It is desirable for a muffler to reduce the noise over a wide range of frequencies with minimal flow blockages in the duct or pipe. Automobile exhausts are one such application where mufflers are used to suppress noise from an engine. Many of the "stock" mufflers provide sufficient noise reduction at the expense of increasing the exhaust back pressure due to flow blockages in the muffler. There are also "straight through" muffler designs that reduce the flow losses, but they have limited noise reduction capability.

A resonator muffler partially accomplishes this sound reduction objective. Helmholtz resonators in the form of side branches and tanks have been used to introduce impedance changes to reduce the overall sound from exhaust systems. Another approach is to use an expansion chamber. It is well established that the area ratio from the sudden expansion controls the amplitude of the noise reduction and the length determines the resonant frequency of the chamber. Expansion chambers provide a wider frequency range of noise reduction compared to side branch and tank mufflers. A schematic of a prior art expansion chamber is shown in FIG. 1. Pictured is a muffler 10 having an inlet 12 and an outlet 14 joined by a through passage pipe 16. The inlet passes through end enclosure 26 and the outlet passes through an outlet end enclosure 28. A plurality of perforations 18 allow gases to pass radially outward through the pipe 16 into an expansion chamber 22. The outer diameter of the expansion chamber is defined by an outer shell 24 forming a confined space with end enclosures 26, 28. The center perforated through pipe 16 is used to reduce the flow losses, but can be removed to make a classical expansion chamber. Resonator mufflers have been shown to work well for low frequencies as long as there is enough space since they can be large in size. However, they often introduce a low frequency system resonance due to acoustic interaction with the tailpipe.

Another type of muffler in common use is called a "dissipative" muffler. Sound absorbing material is used to convert the sound pressure into heat that reduces the amplitude of pressure waves over a range of frequencies. Dissipative mufflers are useful for absorbing sound at frequencies above about 400 Hz. A schematic of a typical dissipative muffler is shown in FIG. 2. As previously described, the muffler 10 has an inlet 12 and an outlet 14 joined by through passage pipe 16. The inlet extends through end enclosure 26 and the outlet extends through end enclosure 28. A plurality of perforations 18 in the pipe 16 allow gases to pass radially outward through the passage 16 into a chamber 30 filled with a suitable dissipative material 20. The outer diameter of the dissipation chamber is defined by an outer shell 24.

SUMMARY OF THE INVENTION

The present invention relates to a sound attenuation device comprising a through passage having an inlet and an outlet. The inlet is adapted to be acoustically coupled to a source of pulsating sound waves such as those generated by an internal combustion engine. The outlet of the through passage is adapted to discharge the attenuated sound waves to the atmosphere either directly or through a tail pipe. The through passage pipe comprises a tubular structure containing a plurality of perforations or passageways between the inlet and the outlet. By tubular is meant any suitable shape such as cylindrical, oval, elliptical or other such shape. The shape can include one or more angles and one or more sides that are planar.

A layer of sound absorbing material surrounds the tubular pipe structure and serves to attenuate the higher frequency sound waves. The density of the material is sufficiently low to allow low frequency sound waves to pass through the material. If the sound absorber is not self supporting, an enclosure such as a mesh screen retains the sound absorber in place. The enclosure is largely transparent to the low frequency sound waves. Finally, a frusto-conical resonant chamber surrounds the sound absorber, said resonant chamber being either converging or diverging from the inlet to the outlet. The resonant chamber serves to reduce low frequency sound.

The present invention also relates to a method of attenuating pulsating sounds such as those emitted by an internal combustion engine. The method utilizes a structure having a through passageway that is substantially transparent to radially and axially extending sound waves. A low density sound absorbing material surrounds the passageway serving to dissipate high frequency sound waves. A frusto-conical resonant chamber around the sound absorbing material serves to attenuate low frequency sound waves.

BRIEF DESCRIPTION OF THE DRAWINGS

These and other features will be more readily understood from the following detailed description of the various aspects of the invention taken in conjunction with the accompanying drawings in which:

FIGS. 5 & 6 provide SPL data and insertion loss results of the muffler shown in FIGS. 4(*a*) and 4(*b*);

FIG. 7 show the sound level plotted against linear frequency in the range of 0 to 300 Hz for the muffler shown in FIGS. 4(*a*) and (*b*); and.

Figure 1:
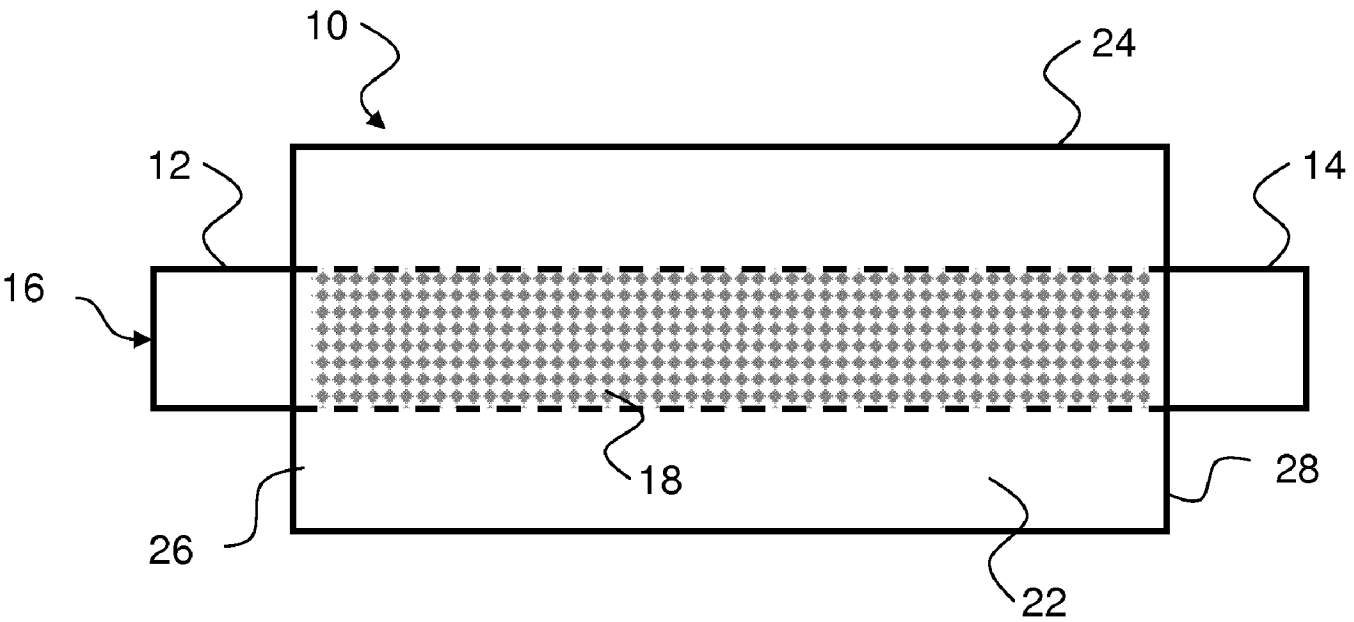
Figure 1 (Prior Art)
FIG. 1 shows a prior art muffler utilizing an expansion chamber.
Figure 2:
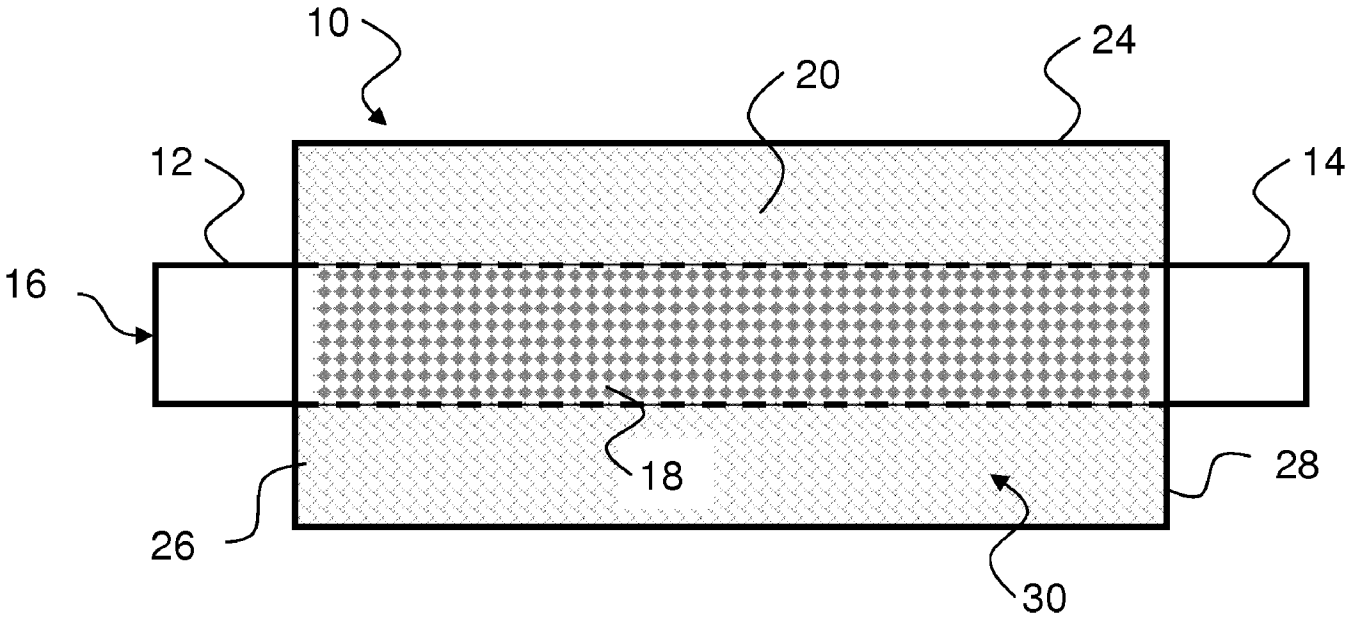
Figure 2 (Prior Art)
FIG. 2 is an example of a prior art dissipative muffler.

The drawings are not necessarily to scale but instead are merely schematic representations, not intended to portray specific parameters of the invention except where specifically noted. The drawings are intended to depict only typical embodiments of the invention, and therefore should not be considered as limiting the scope of the invention. In the drawings, like numbering is used to represent similar elements in the respective views.

DETAILED DESCRIPTION OF THE INVENTION

The muffler according to the present invention comprises a variable attenuation expansion chamber surrounding a dissipative zone. The muffler provides significant noise reduction over a wide range of frequencies. It uses a "straight through" low flow-loss pipe to minimize back pressure. A loosely packed bulk absorber material having an optimized thickness H (see FIG. 3) is used so that the muffler functions as a resonant chamber for low frequencies and a dissipative muffler for higher frequencies. An outer perforated surface around the bulk absorber material allows communication from the dissipation portion of the muffler to a resonant chamber. This surface does not need to be perforated. Instead, any device that is thermally stable, acoustically transparent, and holds the dissipation material in place is sufficient for this purpose. An example of a self supporting material is rigid metal or ceramic foam which can be cemented or otherwise adhered to the through pipe. The interaction between the dissipation material and the outer surface optimizes the noise reduction for higher frequencies. It is desirable to place the dissipation layer one-quarter of a wavelength from the outer surface of the muffler (for both radial and axial waves) for desired peak attenuation frequency.

The resonant chamber is shaped so as to reduce the lowest frequency system resonance that occurs when using a resonator muffler. The outer shell of this chamber preferably is truncated to form a frusto-conical shape along its length. Within the meaning of the present invention, frusto-conical refers generally to a configuration that is round at both ends and tapers from a larger diameter at one end to a smaller diameter at the opposite end. It also contemplates a cross sectional shape that may be elliptical or oval at both ends, again tapering from a larger to a smaller cross section. It is also understood that the cross section from larger to smaller can change from elliptical to oval, from oval to circular, or any combination thereof. It also includes horn shaped configurations. Multi-sided, e.g. octagonal, configurations are also contemplated. The taper does not need to be linear, but may be, for example, parabolic, concave or convex. The frusto-conical shape can either converge (decrease) in size from the inlet toward the outlet, or diverge (increase) from inlet to outlet. The converging shape has been found to provide slightly better results than the diverging design. Using this frusto-conical shape with the dissipation layer also provides a wider frequency range of attenuation since the desired one-quarter wavelength location for both radial and axial waves changes over the length of the muffler.

Acoustic treatment (dissipation) of exhaust gases is most effective when the dissipation layer is located from a reflective surface a distance that is one-quarter of the acoustic wavelength of the frequency that is to be suppressed. This is due to the fact that the particle velocity at this distance is maximized and therefore excites the vibration of the absorbing material to dissipate energy. Some attenuation also occurs along the length of the expansion chamber.

Figure 3:
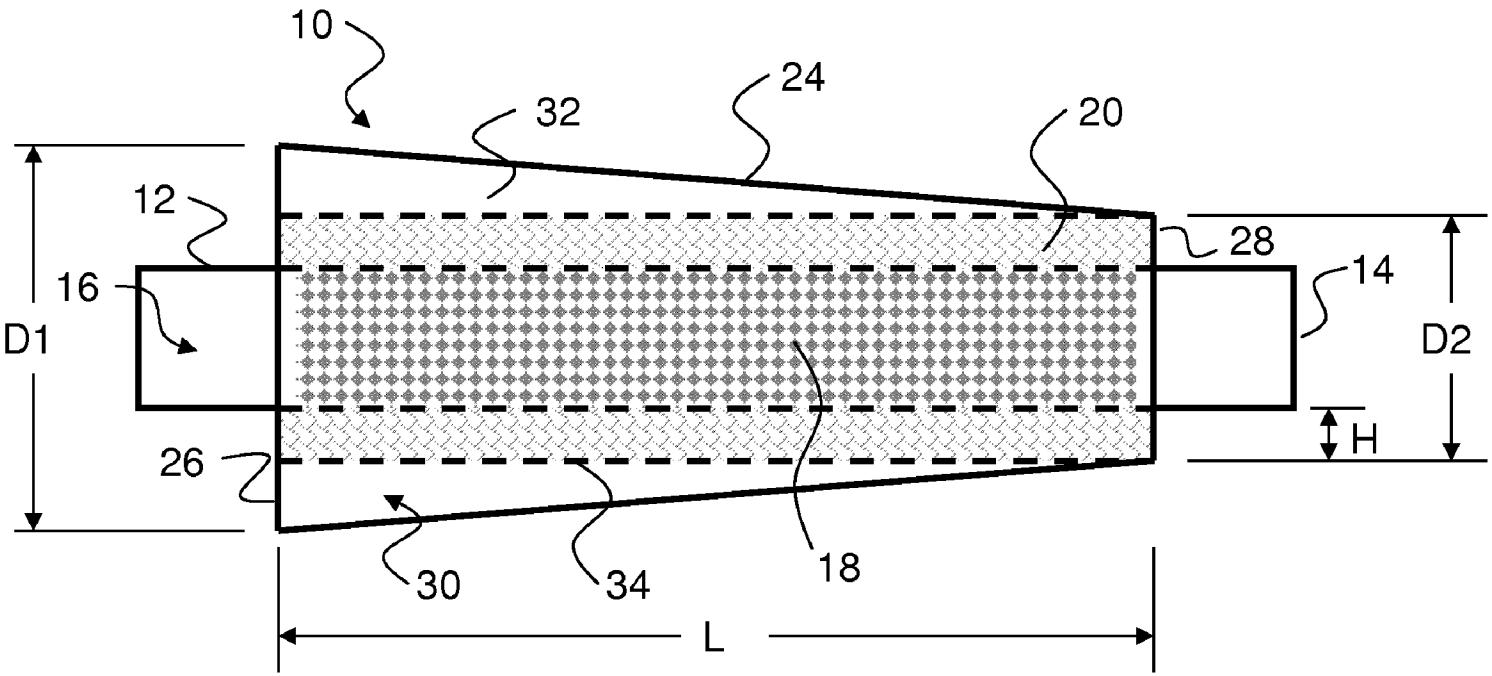
FIG. 3 is a cross sectional view of a muffler according to the present invention.

A schematic of one muffler of the present invention is shown in FIG. 3. The muffler 10 has an inlet 12 and an outlet 14 joined by through pipe 16. The inlet passes through an inlet end enclosure 26 and the outlet passes through an outlet end enclosure 28. A plurality of perforations 18 or pores in the through pipe 16 allow sound waves to pass radially out through a suitable dissipative material 20 in chamber 30 and a perforated containment layer 34 into a conical resonant chamber 32. Thus, the muffler combines the function of a converging (or diverging) expansion chamber with a dissipative layer to attenuate sound over a wide range of frequencies. The dissipative material is a bulk absorber with a density that is low enough to allow low frequency sound waves to communicate with the resonant chamber 32. For best results, the shape of the outer chamber is preferably frusto-conical. The area ratio between the muffler and the pipe controls the amount of noise reduction. A higher area ratio provides higher noise reduction.

As previously noted, the noise reduction from the muffler can be optimized by placing the dissipative material near the one-quarter wavelength of the desired peak attenuation frequency. The outer diameters D1 and D2 of the frusto-conical outer chamber as well as the length L of the muffler can be adjusted, as can the thickness and density of the dissipative material (H) to control the peak attenuation frequency. The range of frequencies that can be attenuated can be adjusted by using a converging or diverging resonant chamber to effectively vary the location of the desired one-quarter wavelength location over the length of the muffler.

Figure 4B:
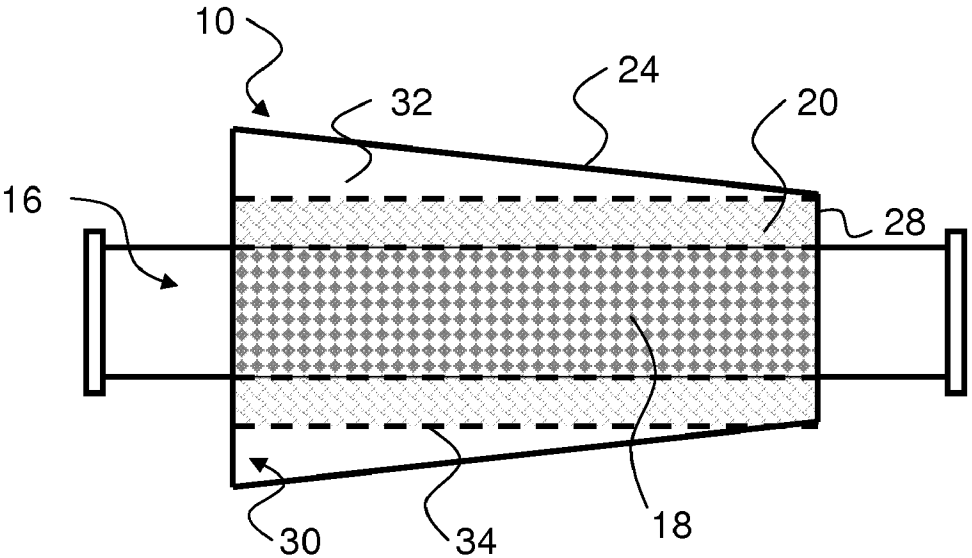
FIG. 4(*a*) is an end view showing the inlet of another muffler of the present invention having an oval shape, and FIG. 4(*b*) is a cross sectional view.
Figure 4A:
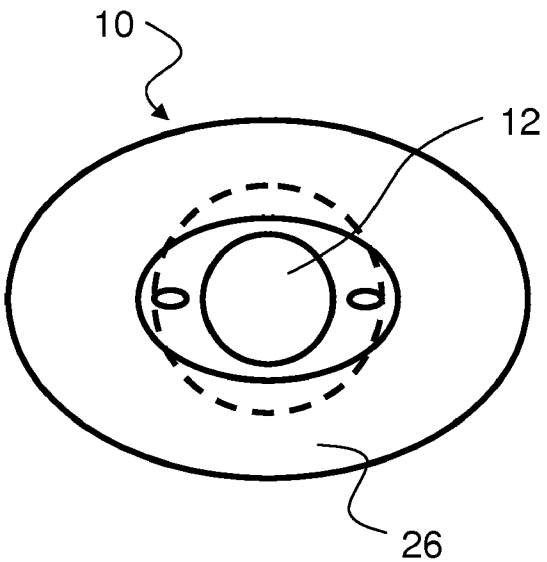

Turning to FIG. 4, there is shown in 4(*a*) an end view of a muffler 10 with an inlet end enclosure 26 and an inlet 12, leading to a through pipe 16, and an outer shell 24. The inlet end enclosure 26 is oval in shape. As shown in FIG. 4(*b*), a plurality of perforations 18 or pores in the through pipe 16 allow exhaust gases to pass radially out through a suitable dissipative material 20 and perforated enclosure 34 into a conical resonant chamber 32. The dissipative material 20 is contained in the space between the through pipe 16, the enclosure 34, the inlet end enclosure 26 and the outlet end enclosure 28. The resonant or expansion chamber 32 is enclosed within an outer shell 24. The muffler combines the function of the expansion chamber with a dissipative layer to attenuate sound over a wide range of frequencies. The dissipative material is a bulk absorber with a density that is low enough to allow low frequency sound waves to communicate with the resonant chamber 32.

The following example provides data comparing the sound spectra of the muffler shown in FIGS. 4(*a*) and 4(*b*), with a muffler (not shown) of the same design but without the dissipation layer.

EXAMPLE 1

A 175.25" long straight pipe was used to define the target resonant frequencies with values that are realistic for an automobile application. A speaker source was used to insert white noise at the inlet end of the pipe. Sound measurements were made at the pipe exit to compare the acoustic spectra with and without a muffler, defined as "insertion loss". The exhaust pipe is 2.5" in diameter. The front (inlet) of the mufflers is located 113.25" from the speaker flange. The muffler designated "Muffler 10A" contains Owen-Corning Advantex 162A fiber bulk absorber material with a bulk density of 0.15 g/cm$^3$ for sound dissipation. The dissipation material fills the volume between the outer perforated pipe 34 and the perforated through pipe 16. The muffler designated "Muffler 10B" does not have the dissipative layer, but does contain the perforated pipes 34, 16.

Narrowband sound pressure level (SPL) spectra were measured for two frequency ranges, 0 to 1250 Hz (FIG. 5) and 0 to 10 kHz (FIG. 6). It is clear that the mufflers give similar insertion loss below about 400 Hz, which means the loose dissipation material allows enough of the low frequency sound to fill the chamber and behave like an open expansion chamber. Above 400 Hz, the dissipation layer becomes effective for absorbing sound. This illustrates the benefit of the dissipation and the resonant chamber to provide both low frequency and high frequency attenuation.

EXAMPLE 2

Another advantage to the frusto-conical resonant chamber is the ability to control the low frequency system resonance that occurs with a resonator near the tailpipe. A 179.75" straight pipe was used as a comparison for this test. The mufflers were mounted near the end of the straight pipe, with the rear of the muffler located 15" from the tailpipe exit. FIG. 7 shows the sound spectra from 0 to 300 Hz measured at the end of a straight pipe (solid black) compared to the spectra from three different mufflers: an expansion chamber partially filled with dissipation (Muffler 9A, bold dotted line); a converging muffler (Muffler 10A, light solid line); and a diverging muffler by switching the direction of Muffler 10A (light dotted line). Notice the tone that is measured near 40 Hz for Muffler 9A that was not present for the straight pipe data. This is the low frequency system resonance that occurs due to the interaction of the resonator (expansion chamber) with the tailpipe. When either the converging or diverging muffler are used, this low frequency tone is shifted to 60 Hz as shown by the light solid and light dotted line spectra, respectively. This demonstrates a way to adjust the resonant frequencies by changing the shape of the resonator.

Figure 8:
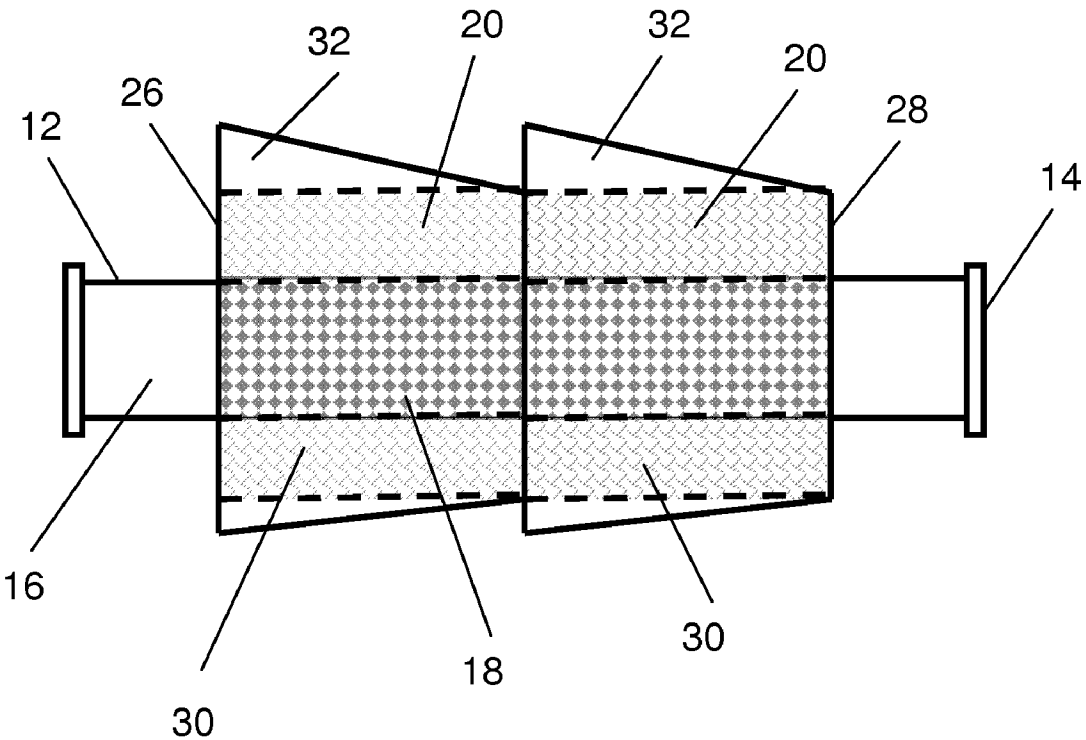
FIG. 8 shows an arrangement of a pair of frusto-conical mufflers in close juxtaposition to one another in accordance with the present invention.

The muffler of the present invention can be used in series with other mufflers including other resonator and/or dissipative mufflers. An example is shown in FIG. 8. Test results (not shown) on this configuration showed up to nearly 40 dB attenuation.

The present invention further contemplates that the muffler may utilize combinations of conical shapes with variations of the cone angle. Other cross sectional shapes beside conical, such as oval, may be effectively used. By using a frusto-conical outer shell, the wall can be made thin, thereby minimizing the overall weight of the muffler compared to that of cylindrical expansion chamber mufflers while at the same time eliminating structural resonance.

The dissipation layer can comprise a flexible or rigid porous material, such as metal and ceramic foam, in which case it does not need to have a perforated sheet on the outer surface. Instead, the porous material merely needs to be retained in place with an acoustically transparent support such as fibrous material, wire mesh or wire strand. The dissipative material may be comprised of strands of a fibrous material such as fiberglass, whereupon a suitable means of containment is necessary to maintain the material in place. Obviously, when used in a muffler for dissipating the sound of a source of hot exhaust gases in the range of 500 to 1000° F., the material should be capable of withstanding the effect of the heat. As previously mentioned, the dissipative material should be loosely packed. In the case of fiberglass, a loose bulk density in the general range less than about 0.30 gm/cm$^3$ (0.0108 pounds per cubic inch, and preferably less than about 0.15 g/cm$^3$ (0.0054 pounds per cubic inch) has been found to be satisfactory. Different loosely packed materials may have different bulk densities depending on the properties of the materials such as particle size and distribution, heat conducting and retaining properties and other factors. When the muffler is used on the exhaust system of a motor vehicle, such as a car or a truck, the thickness (H) of the dissipative material typically may be between about one-half inch and six inches.

The muffler of the present invention has less sensitivity to location in the exhaust system than side branch and tank resonator mufflers. The ends of the muffler can be either flat end plates or truncated cones. The muffler shape can be non-symmetric around the circumference of the muffler. The muffler can be installed in either direction (converging or diverging) to change the acoustic suppression spectra. The muffler can be used to reduce inlet noise or exhaust noise as required. The muffler can be positioned in an exhaust system so as to increase engine valve scavenging similar to racing mufflers, but with the benefit of higher noise reduction due to the combined dissipation/resonance features.

While the invention has been described in combination with embodiments thereof, it is evident that many alternatives, modifications and variations will be apparent to those skilled in the art in light of the foregoing teachings. Accordingly, the invention is intended to embrace all such alternatives, modifications and variations as fall within the spirit and scope of the appended claims. For example, instead of using multiple mufflers having the same configuration, different embodiments of this invention having different sizes and shapes may be used in connection with one another.

What is claimed is:

1. A sound attenuation device for noise reduction over a wide range of frequencies emitted by the exhaust of an internal combustion engine of a motor vehicle comprising:

a. a through passage having an inlet and an outlet, the inlet adapted to be acoustically coupled to pulsating sound waves emitted by said internal combustion engine and the outlet adapted to discharge the attenuated sound waves;

b. the through passage comprising a tubular structure containing a plurality of perforations between the inlet and the outlet;

c. a sound absorbing material surrounding the tubular structure, the density of the material being sufficiently low to allow low frequency sound waves to pass there through; and d. a frusto-conical resonant chamber surrounding and spaced from the sound absorbing material, said resonant chamber being either converging or diverging in shape and having an outer shell, said sound absorbing material located from said outer shell a distance that is one-quarter of the acoustic wavelength of frequencies to be attenuated.

2. The sound attenuation device according to claim 1 further including a containment enclosure around the sound absorbing material to retain aid material in place, said enclosure being substantially transparent to low frequency sound waves below about 1000 Hz.

3. The sound attenuation device according to claim 1 wherein the cross section of the frusto-conical chamber is selected from among the shapes of circular, oval and elliptical.

4. The sound attenuation device according to claim 1 wherein the sound absorbing material comprises a loose packed fibrous material having a bulk density less than about 0.30 g/cm$^3$.

5. The sound attenuation device according to claim 4 wherein the sound absorbing material comprises a loose packed fibrous material having a bulk density less than about 0.15 g/cm$^3$.

6. The sound attenuation device according to claim 4 wherein the loose packed fibrous material is fiberglass.

7. The sound attenuation device according to claim 1 wherein the resonant chamber has an outer shell that is frusto-conical in shape that converges from the inlet to the outlet.

* * * * *